United States Patent [19]

Olson

[11] Patent Number: 4,585,228

[45] Date of Patent: Apr. 29, 1986

[54] WEIGHT ASSEMBLY

[75] Inventor: Scott B. Olson, Bloomington, Minn.

[73] Assignee: North American Sports Training Corporation, Minneapolis, Minn.

[21] Appl. No.: 646,901

[22] Filed: Aug. 31, 1984

[51] Int. Cl.[4] ..... A63B 21/12

[52] U.S. Cl. ..... 272/119; 272/67; 272/143

[58] Field of Search ..... 272/119, 67, 68, 143, 272/116, 122, 96; 128/77; 273/189 A, 54 B

[56] References Cited

U.S. PATENT DOCUMENTS

| | | | |
|---|---|---|---|
| 3,149,839 | 9/1964 | Materia | 272/119 X |
| 3,970,305 | 7/1976 | Hawkins | 273/54 B |
| 4,039,183 | 8/1977 | Sakurada | 272/143 X |
| 4,132,407 | 1/1979 | Davis | 273/54 B |
| 4,330,120 | 5/1982 | Netti | 272/119 |
| 4,369,967 | 1/1983 | Kimura | 272/119 |
| 4,411,422 | 10/1983 | Solloway | 272/116 X |
| 4,521,011 | 6/1985 | Solloway | 272/116 |

FOREIGN PATENT DOCUMENTS

| | | | |
|---|---|---|---|
| 509276 | 7/1939 | United Kingdom | 272/119 |

*Primary Examiner*—Richard J. Apley
*Assistant Examiner*—Robert W. Bahr
*Attorney, Agent, or Firm*—William L. Huebsch

[57] ABSTRACT

A weight assembly adapted to be worn around a hand, wrist and forearm comprising a heavy metal hand stirrup like plate having a central portion adapted to generally cover and extend transversely across the back of the hand, and end portions projecting generally at right angles from opposite ends of its central portion a distance adapted to extend past the palm of the hand; and a tubular grip extending between the end portions adapted to be encircled by the fingers and thumb of the hand. A heavy metal forearm plate extends for a predetermined distance from the wrist longitudinally along the forearm and is attached to the first plate by a hinge having a single pivot axis along the wrist. A flexible cover envelopes the hand and forearm plates and the hinge; and includes a closure for releasably fastening the forearm plate to the forearm.

5 Claims, 4 Drawing Figures

WEIGHT ASSEMBLY

FIELD OF THE INVENTION

The present invention relates to weight assemblies adapted to be worn around the hand, wrist and forearm for purposes of strengthening the arms and improving endurance for running.

BACKGROUND OF THE INVENTION

Weight assemblies adapted to be worn around the hand, wrist and forearm for purposes of strengthening the arms and improving endurance for running are known in the art. U.S. Pat. No. 4,330,120 describes one example. While the weight assembly described in that patent provides weights at the back and palm of the hand and along the forearm, the assembly is not as easy to put on and take off as may be desired, and provides only flexible cloth connections between the weights.

DISCLOSURE OF THE INVENTION

The present invention provides a weight assembly adapted to be worn around the hand, wrist and forearm that is very easy to put on and take off, and which provides weights at the palm and back of the hand and along the forearm that are interconnected so that they will maintain a predetermined relationship when the weight assembly is being worn.

According to the present invention there is provided a weight assembly comprising a first heavy metal (e.g., lead) stirrup like hand plate having a central portion adapted to generally cover and extend transversely across the back of the hand with one edge extending generally across the wrist, and end portions projecting generally at right angles from opposite ends of the central portion a distance adapted to extend past the palm of the hand. A generally tubular grip extends between the end portions, and is spaced from the central portion so that it can be encircled and grasped by the thumb and fingers on the hand. Also included in the weight assembly is a second heavy metal (e.g., lead) comfortable forearm plate adapted to extend for a predetermined distance longitudinally along the forearm from the wrist. A hinge pivotable about a single axis is connected between the adjacent edge of the hand and forearm plates to both fix the relative positions of the plates and to afford pivotal motion between the plates at the wrist. A flexible cover envelopes the hand and forearm plates and the hinge and means are provided on the cover for releasably fastening the forearm plate around the forearm.

Preferably the first and second plates are made of lead, but alternatively they could be made of other heavy metals such as copper or iron.

Also preferably, the cover is of an elastic material and includes a cuff like part extending around a second edge of the forearm plate opposite the hand plate and a short distance along the surface of the forearm plate opposite the grip, and an outer part overlying the surface of the forearm plate opposite the grip and the cuff. The outer part has an edge extending generally along the second edge of the forearm plate and is unattached to the cuff to afford separation of the cuff and outer part. The weight assembly can optionally also include a weighting plate adapted to be removably positioned between the cover and the forearm plate on the side of the forearm plate opposite the grip, which weighting plate may be inserted and removed between the cuff and the outer part of the cover to change the weight of the weight assembly, should that be desired.

Additionally the weight assembly preferably further includes two metal tabs and hinges attaching the tabs in edge to edge relationship with the forearm plate along its side edges and adjacent its end opposite the hand plate for pivotal movement between an open position with the tabs generally parallel and projecting away from the forearm plate to afford positioning the forearm plate along the forearm with the tabs projecting transversely along opposite sides of the forearm, and a closed position with the ends of the tabs opposite the forearm plate adjacent and spaced from the forearm plate to afford encirclement of the forearm by the forearm plate and tabs. The cover envelops the tabs, and the means for attaching attaches portions of the cover together adjacent the ends of the tabs opposite the forearm plate.

BRIEF DESCRIPTION OF THE DRAWING

The present invention will be further described with reference to the accompanying drawings wherein like numbers refer to like parts in the several views, and wherein.

DESCRIPTION OF THE PREFERRED EMBODIMENT

Figure 1:
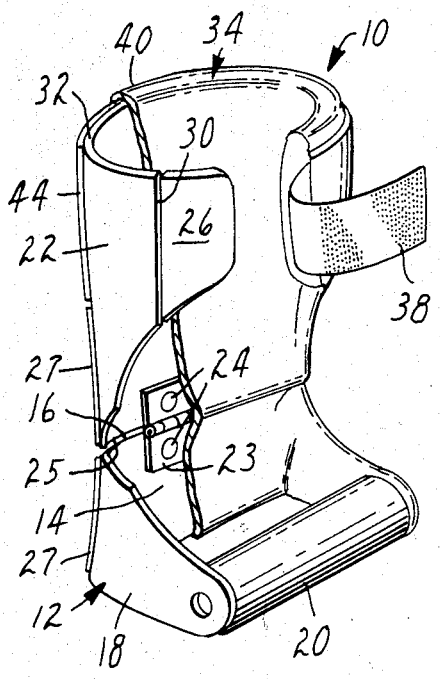
FIG. 1 is a perspective view of a weight assembly according to the present invention having parts broken away to show details.

Referring now to the drawing there is shown a weight assembly 10 according to the present invention, which weight assembly 10 is adapted to be worn around the hand, wrist and forearm.

As is best seen in FIG. 1, the weight assembly 10 comprises a first generally U or stirrup shaped heavy metal (e.g., lead) hand plate 12 having a central portion 14 adapted to generally cover and extend transversely across the back of the hand with one edge 16 extending generally across the wrist, and end portions 18 projecting generally at right angles from the ends of the central portion 14 a distance adapted to extend past the palm of the hand. A generally tubular or cylindrical grip 20 covered in a layer of resiliently compressible foam rubber is fixed at its ends to (as by bolts 21) and extends between the end portions 18, and is spaced from the central portion 14 so that it can be encircled, grasped and squeezed by the fingers and thumb on the hand. The grip 20 may have different diameters and surface contours and may be covered by rubber of different thicknesses and durometers as is desired by a user for comfort and to provide different resistances to squeezing.

Also included in the weight assembly 10 is a second heavy metal (e.g., lead) forearm plate 22 which is arcuate about an axis oriented at about a right angle to the axis of the grip 20 and is adapted to extend for a predetermined distance longitudinally along the forearm from the wrist. A hinge 23 is connected between the hand plate 12 and the forearm plate 22 with the pivot axis for the hinge 23 extending along the edge 16 and an adjacent edge 25 of the forearm plate 22, which edges 16 and 25 are in alignment. The hinge 23 provides means to pivotably connect the forearm plate 22 to the hand plate 12 and affords pivotal motion between the hand and forearm plates 16 and 22 along a single axis at the wrist line. The hinge 23 is connected to the forearm plate 2 and hand plate 12 by rivots 24 which pass through the plates 12 and 22 and through rectangular heavy metal (e.g. lead) back up plates 27 which both provide reinforcement for the rivot engagement and add to the weight of the assembly 10.

Figure 3:
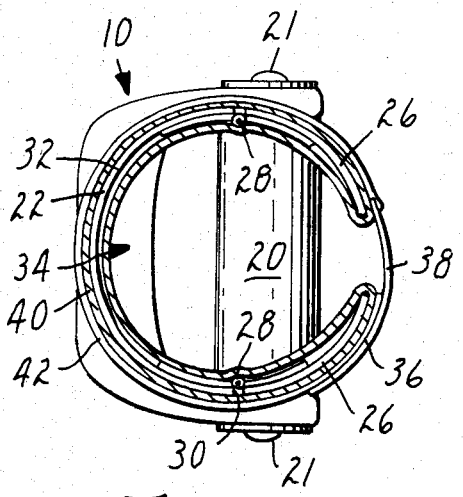
FIG. 3 is a sectional view taken approximately along lines 3—3 of FIG. 2.
Figure 4:
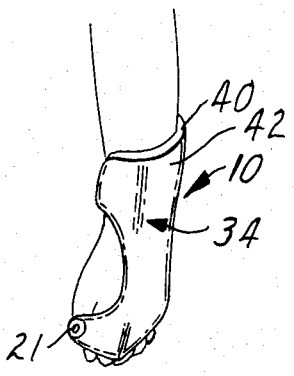
FIG. 4 is a reduced perspective view showing the weight assembly of FIG. 1 being worn on a hand.

A pair of plate metal (e.g. lead) tabs 26 are attached by hinges 28 in edge to edge relationship with the forearm plate along its side edges 30 and adjacent its edge 32 opposite the hand plate 12 for pivotal movement between an open position (not shown) with the tabs generally parallel and projecting away from the forearm plate 22 to afford positioning the forearm plate 22 along the forearm with the tabs passing transversely along opposite sides of the forearm, and a closed position (FIG. 3) with the ends of the tabs 26 opposite the forearm plate 22 adjacent and spaced from the forearm plate 22 to afford almost complete encirclement of the forearm by the forearm plate 22 and tabs 26.

A form fitting cover 34 of flexible elastic material (e.g., a layer of about ⅛ inch thick closed cell neoprene foam having a woven nylon fabric adhered to both of its surfaces, such as is sold by Rubatex Corp., Bedford, Va.) envelopes the hand and forearm plates 16 and 22, the hinges 23 and 28 and the tabs 26. Means in the form of a strip 36 of hook material sewed to the cover 34 over one tab 26 and a strip 38 of loop material having one loose end portion and an opposite end portion sewed to the cover 34 over the other tab 26 (e.g., the mating strips sold under the trade designation "Velcro"), are provided for releasably fastening the forearm plate 22 to the forearm when the tabs 26 are in their closed positions.

Preferably, the cover 34 includes a cuff like part 40 that extends around the edge 32 of the forearm plate 12 opposite the hand plate 12 and a short distance along the surface of the forearm plate 22 opposite the grip 20, and an outer part 42 overlying the surface of othe forearm plate 22 opposite the grip 20 and the cuff 40. The outer part 42 of the cover 34 has an edge generally along the edge 32 of the forearm plate 22 and is not attached to the cuff 40 so that the cuff 40 and outer part 42 can be separated to afford application and removal of the cover over the plates 12, 22, 26 and the hinges 23 and 28 by passing them through the opening therebetween.

Figure 2:
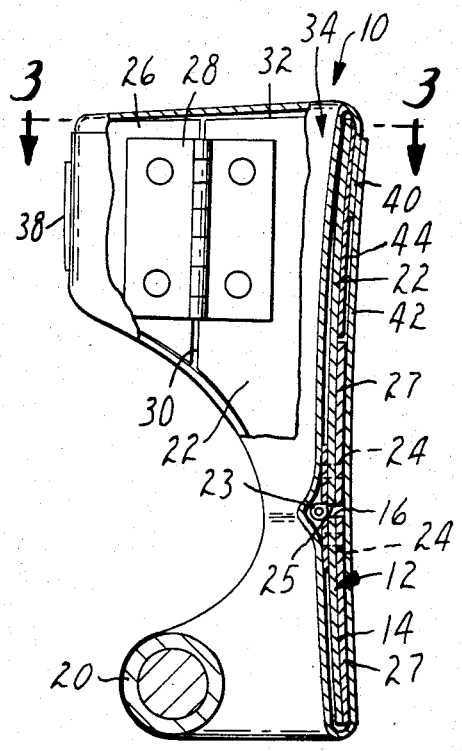
FIG. 2 is a side view of the weight assembly of FIG. 1 having parts broken away to show details.

The weight assembly 10 also may include a generally rectangular heavy metal (e.g., lead) weighting plate 44 adapted to be removably positioned between the cover 34 and the forearm plate 22 on the side of the forearm plate 22 opposite the grip 20 (shown in FIGS. 1 and 2 only), which weighting plate 44 may be inserted and removed between the cuff 40 and the outer part 42 of the cover 34, and can then be retained in that position edge to edge with the adjacent back up plate 27 under the cuff 40; the purpose of the weighting plate 44 being to add extra weight to the weight assembly 10, should that be desired.

The present invention has now been described with reference to a single embodiment of the weight assembly. It will be apparent to those skilled in the art that certain structural details of that embodiment may be changed without departing from the spirit of the invention. Thus the claims should not be limited by the structure described in this specification, but only by the structures and method steps described by the language of the claims and their equivalents.

I claim:

1. A weight assembly adapted to be worn around the hand, wrist and forearm comprising:

a heavy metal stirrup like hand plate having a central portion adapted to generally cover and extend transversely across the back of the hand, a transverse edge adapted to extend generally across the wrist, and end portions projecting generally at right angles from opposite ends of their central portion a distance adapted to extend past the palm of the hand;

a generally tubular grip extending between said end portions, spaced from said central portion and adapted to be encircled and grasped by the fingers and thumb of the hand;

a heavy metal forearm plate adapted to extend for a predetermined distance longitudinally along one side of the forearm from adjacent the wrist, and having an adjacent edge adjacent the transverse edge of said hand plate;

a hinge connected between said hand plate and said forearm plate to afford pivotal movement therebetween along only a single axis between said transverse and adjacent edges;

a flexible cover enveloping said plates and said hinge and means for releasably fastening said plate to said forearm.

2. A weight assembly according to claim 1 wherein said hand and forearm plates are of lead.

3. A weight assembly according to claim 1 wherein said forearm plate has a second edge opposite said adjacent edge, and said cover is of an elastic material and includes a cuff like part extending around said second edge and a short distance along the surface of said forearm plate opposite said grip, and an outer part overlying the surface of said forearm plate opposite said grip and said cuff, said outer part having an edge aligned generally along said second edge of said forearm plate and being unattached to said cuff to afford separation of said cuff and outer part.

4. A weight assembly according to claim 1 wherein said forearm plate has a second edge opposite said adjacent edge and side edges extending between said adjacent edge and said second edge; and said weight further includes metal tabs and hinge means attaching said tabs in edge to edge relationship with said forearm plate along its side edges and adjacent said second edge for pivotal movement between an open position with said tabs generally parallel and projecting away from said forearm plate to afford positioning said forearm plate along the forearm with the tabs projecting transversely along opposite sides of the forearm, and a closed position with the ends of said tabs opposite said forearm plate adjacent and spaced from said forearm plate to afford encirclement of the forearm by said forearm plate and tabs; said cover envelops said tabs; and said means for attaching attaches portions of said cover together adjacent the edges of said tabs opposite said forearm plate.

5. A weight assembly according to claim 3 further including a heavy metal weighting plate adapted to be removably positioned between said cover and said forearm plate on the side of said forearm plate opposite said grip, to be inserted and removed between said cuff and the outer part of said cover, and to be patially retained in position by said cuff.

* * * * *